US006523640B1

(12) United States Patent
Young et al.

(10) Patent No.: US 6,523,640 B1
(45) Date of Patent: Feb. 25, 2003

(54) UNDERCARRIAGE FOR MOBILE LADDERS AND PLATFORMS

(75) Inventors: David T. Young, Oconomowoc, WI (US); Scott E. Kaczor, Greenfield, WI (US)

(73) Assignee: EGA Products, Inc., Brookfield, WI (US)

( * ) Notice: Subject to any disclaimer, the term of this patent is extended or adjusted under 35 U.S.C. 154(b) by 0 days.

(21) Appl. No.: 09/862,026

(22) Filed: May 21, 2001

(51) Int. Cl.[7] ..... E04G 3/16; E04G 3/14
(52) U.S. Cl. ..... 182/17; 182/15; 182/39
(58) Field of Search ..... 182/17, 36, 39, 182/12, 38, 15, 84, 86, 97, 127; 280/47.16

(56) References Cited

U.S. PATENT DOCUMENTS

| | | | | |
|---|---|---|---|---|
| 321,342 A | | 6/1885 | Covert | |
| 1,239,498 A | | 9/1917 | Madigan | |
| 1,355,173 A | | 10/1920 | Shadel et al. | |
| 1,360,208 A | | 11/1920 | Gamble et al. | |
| 2,216,972 A | | 10/1940 | Gibson et al. | |
| 2,380,160 A | * | 7/1945 | Fieroh | 182/13 |
| 2,585,763 A | | 2/1952 | Gasner et al. | |
| 2,624,590 A | | 1/1953 | Tilton | |
| 2,798,652 A | * | 7/1957 | Easton | 182/17 |
| 2,923,373 A | * | 2/1960 | Ledgerwood | 182/17 X |
| 3,112,010 A | * | 11/1963 | Mihalik | 182/15 X |
| 3,155,190 A | | 11/1964 | Borgman | |
| 3,291,254 A | | 12/1966 | Mihalik | |
| 3,684,055 A | | 8/1972 | Rice | |
| 3,685,851 A | | 8/1972 | Berry | |
| 4,063,616 A | | 12/1977 | Gutierrez | |
| 4,166,516 A | * | 9/1979 | Thurmond, Jr. | 182/15 |
| 4,194,591 A | * | 3/1980 | Fisher | 182/17 |
| 4,793,624 A | | 12/1988 | Mace | |
| 5,082,086 A | * | 1/1992 | Kerr | 182/17 |
| 5,411,111 A | * | 5/1995 | Greve | 182/17 |
| 5,791,434 A | * | 8/1998 | Swiderski | 182/17 |
| 5,941,341 A | | 8/1999 | Gillis et al. | |
| 6,039,147 A | | 3/2000 | Gillis et al. | |
| 6,179,087 B1 | * | 1/2001 | Moffat | 182/15 |
| 6,305,496 B1 | * | 10/2001 | Bieszczad | 182/15 |

FOREIGN PATENT DOCUMENTS

| | | |
|---|---|---|
| CA | 1021831 | 11/1977 |
| GB | 20022301 | 2/1979 |

* cited by examiner

*Primary Examiner*—Daniel P. Stodola
*Assistant Examiner*—Hugh B. Thompson
(74) *Attorney, Agent, or Firm*—Andrus, Sceales, Starke & Sawall, LLP

(57) ABSTRACT

An undercarriage for a mobile ladder stand or other similar warehouse apparatus includes a pair of retractable wheels located at the rear of the undercarriage frame and a pair of retractable wheels located at the middle of the undercarriage frame. When the wheels are retracted, the structure is supported by a pair of legs and foot pads located at the front of the undercarriage frame and another pair of legs and foot pads located at the rear of the undercarriage frame. When the wheels are extended, the structure is supported on the ground surface for rolling by the middle and rear wheels. The rear wheels are preferably mounted on swivel casters and the diameter of the middle pair of wheels is preferably greater than the diameter of the rear pair of wheels.

22 Claims, 4 Drawing Sheets

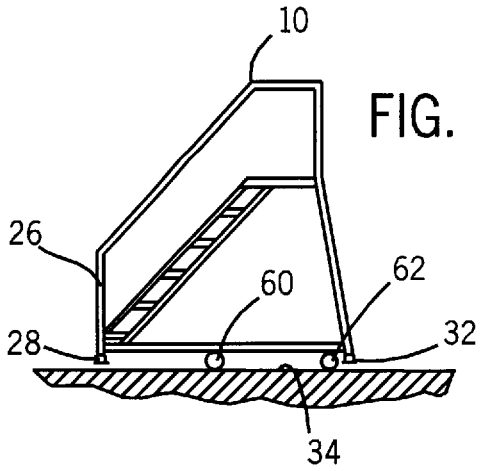
FIG. 2
FIG. 1
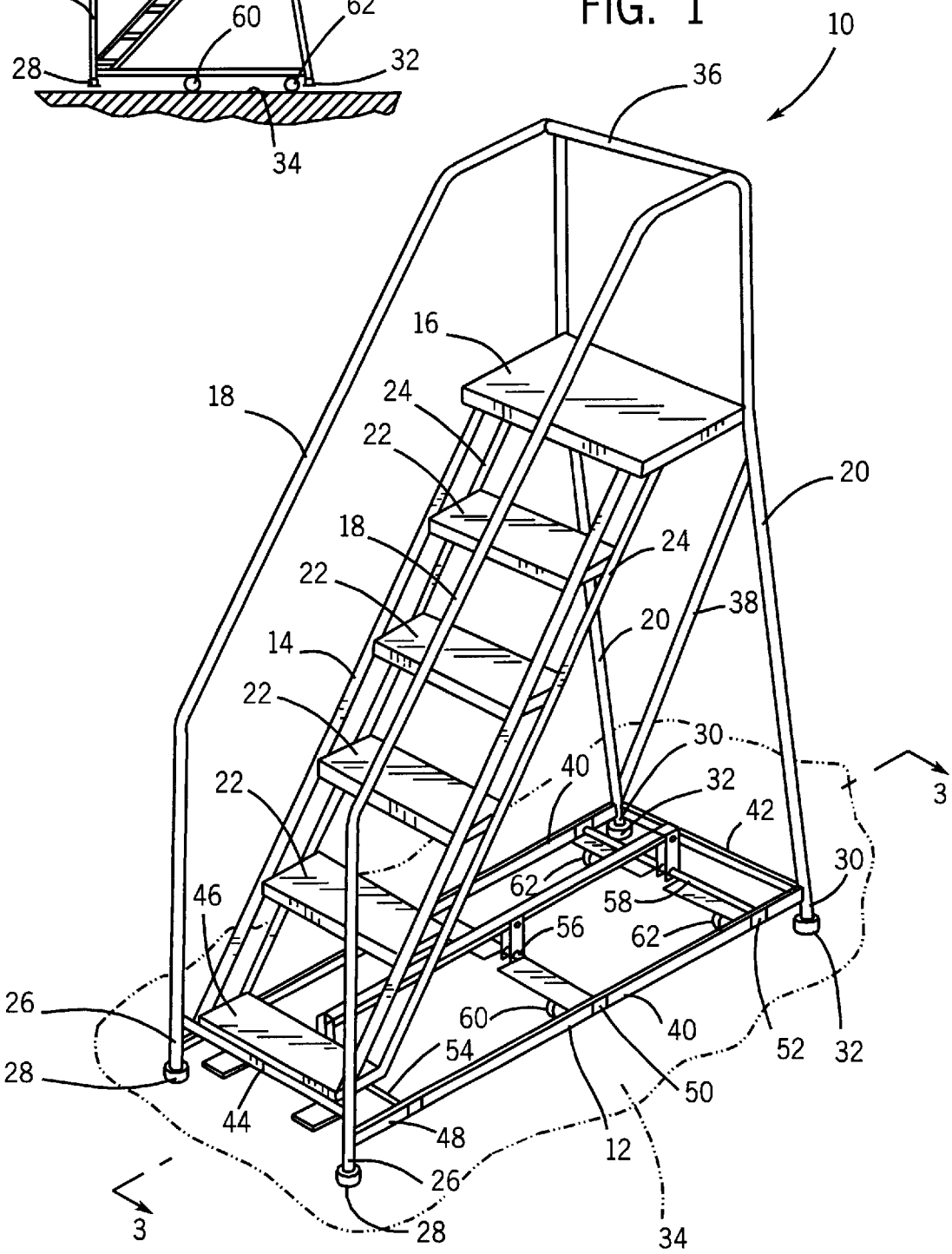

UNDERCARRIAGE FOR MOBILE LADDERS AND PLATFORMS

FIELD OF THE INVENTION

The invention relates to a wheeled undercarriage for mobile ladder stands and platforms. In particular, the undercarriage has four retractable wheels that are positioned specifically at the rear and at the middle of the undercarriage, thereby providing enhanced mobility for mobile ladder stands and platforms.

BACKGROUND OF THE INVENTION

Mobile ladder stands are used by workers and others who need to reach products or materials stored on shelves in stores and warehouses. Mobile ladder stands typically have one or two pairs of support legs mounted at the front and/or rear of the frame undercarriage, as well as two or three pairs of wheels mounted to the undercarriage frame. In a conventional four-wheeled, mobile ladder stand, a pair of retractable wheels is located towards the front of the ladder stand adjacent a front pair of legs. Another pair of retractable wheels is mounted at the rear of the frame undercarriage near a rear pair of legs. An actuation mechanism is provided to extend and retract the front and the rear wheels in unison. When the wheels are extended, the mobile ladder stand (or mobile platform) is supported on the ground surface by the extended wheels, and the mobile ladder stand can be manually pushed or rolled in order to position the ladder stand for use. When the wheels are retracted, the ladder stand is supported on the ground surface by foot pads at the bottom of the front and rear legs, thereby preventing the ladder stand from rolling. In a conventional four-wheeled ladder stand, the rear wheels are fixed and the front wheels (i.e., the wheels located near the lowermost stair tread) are swivel casters. This arrangement allows the front swivel casters to track the straight path of the rear wheels when the ladder stand is pushed down an aisle, but the front swivel casters also allow the ladder stand to be maneuvered around corners or the like. As mentioned, these ladder stands typically have actuation mechanisms to extend and retract the wheels. However, some four-wheeled ladder stands do not include the rear pair of legs and footpads. In this configuration, the rear pair of wheels are not retractable and remain in contact with the ground surface when the ladder stand is in both a mobile position and a non-mobile position. When the front wheels are retracted, a ladder stand with this configuration is supported on the ground surface in a non-mobile, fixed position by the front footpads and the rear wheels. The rear wheels in this configuration are not swivel casters.

Typically, the actuation mechanism includes either a foot lever or a hand lever to extend the wheels and lift the ladder stand (or mobile platform) off of the footpads at the bottom of the legs. The actuation mechanism typically includes some sort of locking mechanism that locks the wheels in the extended position until the weight of the user manually actuates a release lever. In a mobile ladder stand, the release lever normally responds to the weight of the user from the user's foot before the user steps onto the ladder stand. For example, the release lever can consist of a foot bar near the lowermost stair tread, or the lowermost stair tread can itself be made pivotable and, in fact, act as the release lever.

Large mobile ladder stands (or large mobile platforms) become awkward to maneuver in small spaces because the turning radius increases as the length of the undercarriage increases. This problem has been addressed in the industry by the provision of six-wheeled ladder stands such as disclosed in Gillis, et al., U.S. Pat. No. 6,039,147 and U.S. Pat. No. 5,941,341, both entitled "Mobile Ladder Stand." These patents disclose a mobile ladder stand that has a front pair of wheels mounted to the front of the ladder base beneath the top of the first stair tread, a center pair of wheels mounted to a center beam of the ladder base, and a rear pair of wheels mounted to the rear of the ladder base. A set of legs and footpads are mounted to the front of the ladder base. The front and center wheels are retractable. The front pair of wheels are swivel casters. The diameter of the center pair of wheels is preferably larger than the diameter of the front and rear pair of wheels. When the front and center wheels are extended, the ladder is supported on the ground surface by the front and center wheels, and the rear wheels and the front support feet are not generally in contact with the ground surface. In this position (i.e. the mobile position), the ladder stand can be rolled and the turning radius of the ladder is defined generally by the distance between the center pair of wheels and the front pair of swivel casters. When the front and center wheels are retracted (i.e. non-mobile position), the ladder stand is supported on the ground surface by the front footpads and the rear wheels, and rolling is prevented. Although it is not preferred, the Gillis, et al. patents suggest that the rear wheels can be replaced by a pair of foot pads at the rear of the base.

An object of the invention is to provide another undercarriage for a mobile ladder stand or other mobile warehouse apparatus (e.g., mobile platform), in which the undercarriage is actuated between a mobile and non-mobile position, and provides a turning radius and maneuverability similar to the aforementioned six-wheeled ladder stand disclosed in Gillis, et al. U.S. Pat. Nos. 6,039,147 and 5,941,341.

SUMMARY OF THE INVENTION

The invention is an undercarriage for a mobile ladder stand or other similar warehouse apparatus that includes a pair of retractable wheels located at the rear of the undercarriage frame and a pair of retractable wheels located in the middle of the undercarriage frame. The undercarriage includes a front pair of legs and footpads located at the front of the undercarriage frame and a rear pair of legs and footpads located at the rear of the undercarriage frame. The rear pair of retractable wheels are swivel casters, and the middle pair of retractable wheels are fixed. There are no wheels at the front of the undercarriage frame. The undercarriage also includes an actuation mechanism that extends and retracts the middle and rear wheel sets. When the middle and rear wheels are extended (i.e., the mobile position), the ladder stand (or mobile platform) is supported on the ground surface by the middle and rear wheel sets thus enabling the ladder (or mobile platform) to be rolled along the ground surface. When the wheels are extended and the undercarriage is in the mobile position, the turning radius is generally defined by the distance between the middle set of wheels and the rear set of swivel casters, thereby rendering the undercarriage more easily maneuvered than other commercially available four-wheeled, mobile ladder stands.

The middle set of wheels and the rear set of swivel casters are preferably extended and retracted in unison. When the middle pair of wheels and the rear pair of wheels are retracted, the undercarriage is supported on the ground surface by the pair of footpads at the front of the undercarriage frame and the other pair of footpads at the rear of the carriage frame. This provides an especially sturdy support when the ladder stand (or mobile platform) is in the non-mobile position.

The preferred actuation mechanism includes a front pivotable lever connected to a foot pedal located near the front of the undercarriage frame. The foot pedal is actuated by the user in order to extend the wheels and lift the front and rear footpads off the ground surface. The front pivotable lever connected to the foot pedal is also connected by a mechanical linkage to a middle pivotable lever connected to the middle retractable wheel set and a rear pivotable lever connected to the rear retractable wheel set. Preferably, a connecting rod connects directly to the front pivotable lever, the middle pivotable lever and the rear pivotable lever in order to facilitate the extension and retraction of the wheels in unison. A spring-loaded locking mechanism preferably locks the actuation mechanism when the wheels are in the extended position in order to allow the mobile ladder stand (or mobile platform) to be rolled over the ground surface. A release lever actuated by a foot bar or a pivoting lowermost stair tread is provided. When the user steps on the release lever with their foot, the combined weight of the ladder and user causes the extended wheels to retract and push the actuation mechanism against the force of the spring. This allows the undercarriage to rest on the front and rear foot pads in the non-mobile position.

Preferably, the diameter of the middle pair of retractable wheels is larger, for example about five inches, than the diameter of the rear wheel set, for example about four inches. With this configuration, it is easy to tilt the undercarriage rearward when the wheels are extended so that the undercarriage rides on the middle and rear pairs of wheels with sufficient clearance for the front foot pads above the ground surface.

It should be apparent to those skilled in the art that a four-wheeled, mobile ladder stand constructed in accordance with the preferred embodiment of the invention allows the user to push the ladder stand efficiently in a straight direction, and also allows the user to turn the mobile ladder stand around a corner by pivoting about the center wheels and allowing the swivel casters of the rear wheel set to turn in the direction of the corner. In this matter, a four-wheeled mobile ladder stand (or mobile platform) constructed in accordance with the invention is able to turn around tight corners (for example, 90° corners), with only approximately ½ of the turning radius of a normal, four-wheeled ladder stand.

BRIEF DESCRIPTION OF THE DRAWINGS

FIG. 1 is perspective view of a four wheel mobile ladder stand constructed in accordance with the invention.

FIG. 2 is schematic view of the four wheel mobile ladder stand shown in FIG. 1 showing the wheels extended so that the mobile ladder stand is in the mobile position.

DETAILED DESCRIPTION OF THE INVENTION

Figure 3:
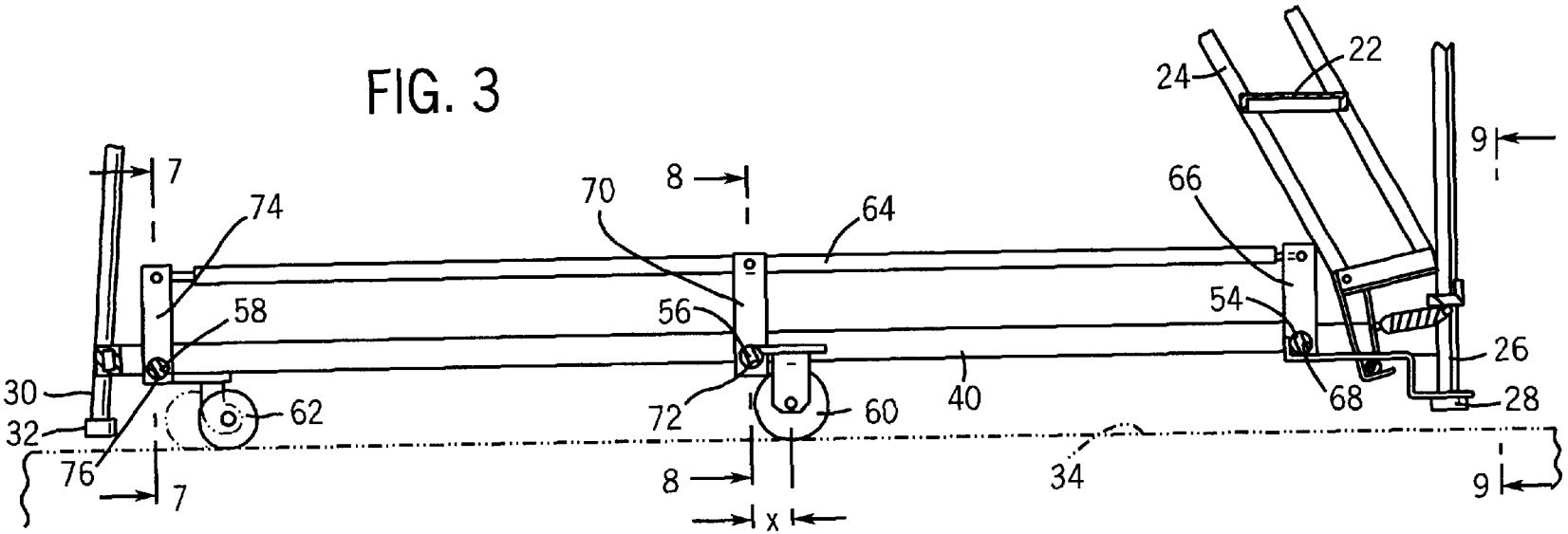
FIG. 3 is a sectional view taken along the line 3—3 in FIG. 1 which shows the wheels extended so that the mobile ladder stand is in the mobile position.

The drawings illustrate a preferred embodiment of the invention in which a four wheel undercarriage supports a mobile ladder stand 10. It should be apparent to those skilled in the art, however, that the undercarriage may be useable for transporting other devices such as mobile carts or the like. Referring in particular to the mobile ladder stand 10 of FIG. 1, the stand 10 includes an undercarriage 12, a staircase 14, an upper platform 16, handrails 18, and vertical supports 20. The staircase 14 include four stair treads 22 that are fixed to staircase support rails 24. The fixed stair treads 22 ascend upward towards the upper platform 16 which is also welded to the staircase support rails 24. The upper platform 16 is also welded to vertical supports 20. Preferably, the handrail and the vertical support 20 on each side of the mobile ladder stand 10 are constructed from the same piece of bent steel tubing. The bottom portions of the hand rails 18 constitute a front pair of legs 26. Foot pads 28 are located at the bottom of the front legs 26. Likewise, the lower portions of the vertical supports 20 form rear legs 30, and foot pads 32 are located at the bottom of the legs 30. When the ladder stand 10 is in the non-mobile position, the ladder stand 10 stands on the ground surface 34 via foot pads 28 and 32 at the front and rear of the ladder stand respectively.

A cross support 36 is welded between the tops of the vertical supports 20. A cross support 38 is also welded between the vertical supports 20.

The undercarriage 12 includes a frame consisting of two side beams 40 and a rear cross beam 42. The side beams 40 are welded between the front legs 26 and the rear legs of the respective side of the ladder stand 10. The rear cross beam 42 is welded between the rear legs 30. In addition, a front cross beam 44 is welded between the front legs 26. The front cross beam 44 preferably also acts as a lever stop for the lower most stair tread 46. The lower most stair tread, is as will be explained below, is preferably pivotable and serves as the actuation lever for the release mechanism.

The undercarriage frame 12 includes a front portion 48, a middle portion 50, and a rear portion 52. A front pivot bar 54 is connected between the front portions of the side 48 of the side beams 40. A middle pivot bar 56 is connected between the middle portions 50 of the side beams 40, and a rear pivot bar 58 is connected between the rear portions 52 of the side beams 40. A middle retractable wheel set 60 is pivotally connected to the middle pivot bar 56, and a rear retractable wheel set 62 is pivotally connected to the rear pivot bar 58.

Figure 4:
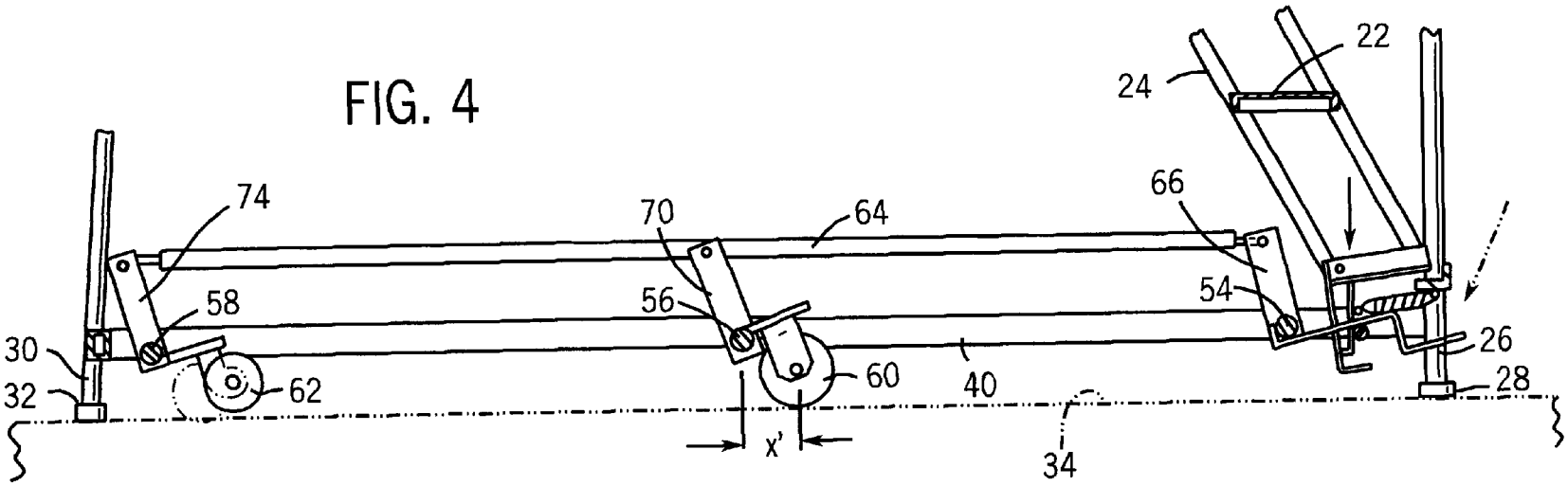
FIG. 4 is a view similar to FIG. 3 which shows the wheels retracted so that the mobile ladder stand is supported by legs and foot pads in the non-mobile position.
Figure 7:
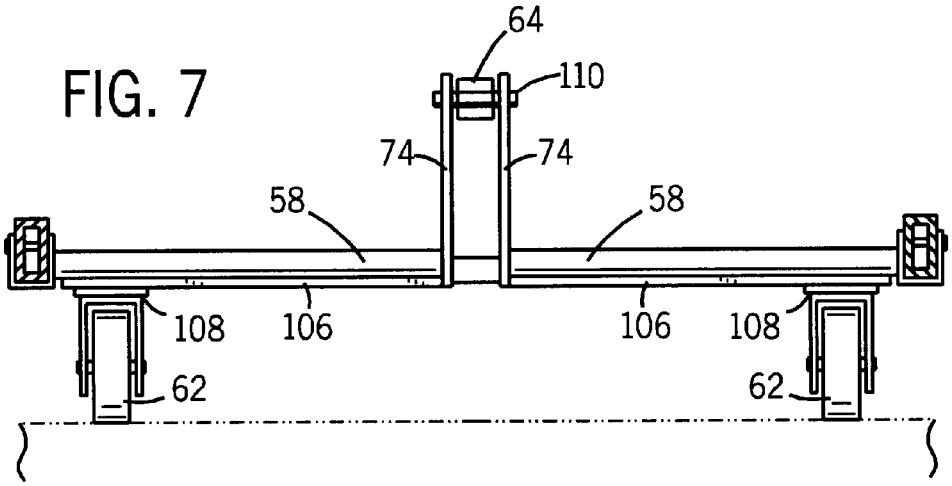
FIG. 7 is a view taken along the line 7—7 in FIG. 3.
Figure 8:
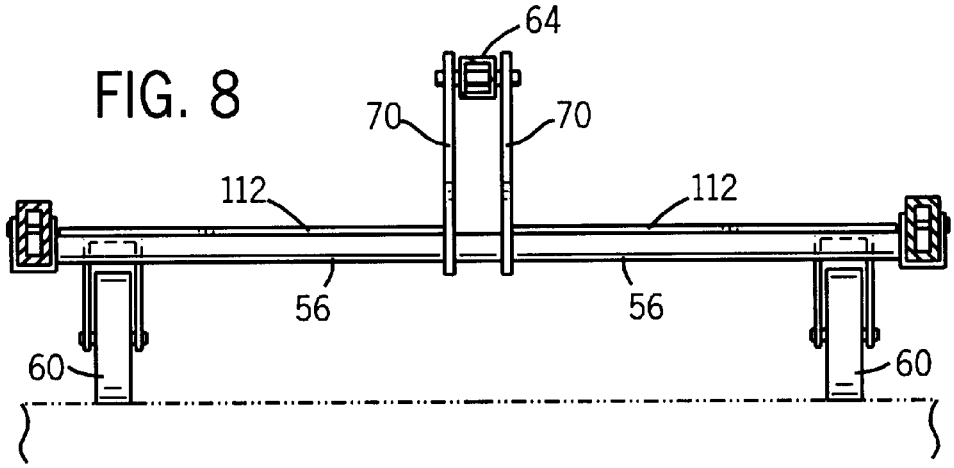
FIG. 8 is a view taken along the line 8—8 in FIG. 3.
Figure 9:
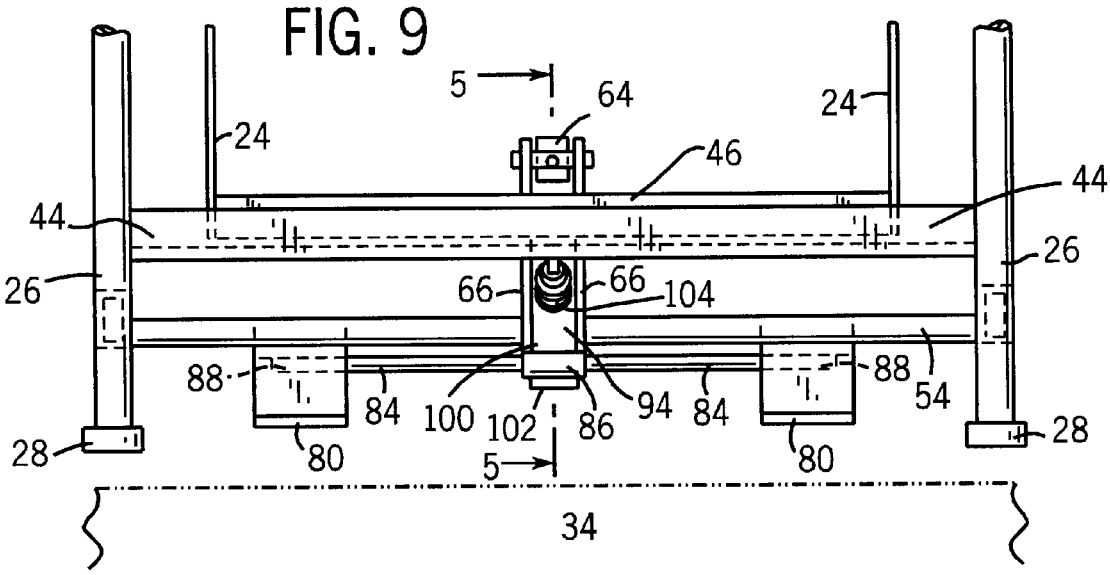
FIG. 9 is a view taken along the line 9—9 in FIG. 3

Referring now to FIGS. 3 and 4, a front pivotable lever 66 includes a pivotable collar 68 (e.g. opening 68) through which front pivot bar 54 passes. Similarly, middle pivot lever 70 contains pivotable collar 72 through which middle pivot bar 56 passes. Rear pivotable lever 74 contains pivotable collar 76 through which pivot bar 58 passes. As shown in FIGS. 7 through 9, a connecting rod 64 directly connects the upper most ends of the pivotal levers 66, 70, 74. Front pivotal lever 66 is actuated by the actuation mechanism (described below) in order to move the connecting rod 64 rearward or forward. As the connecting rod 64 is moved forward, the middle pivotal lever 70 and the rear pivotal lever 74 are rotated rearward and the wheels 60, 62 are retracted in FIG. 4. When the wheels are retracted as shown in FIG. 4, the weight of the ladder stand is supported on foot pads 32 and 28. In order to extend the wheels 60, 62, the connecting rod 64 is moved rearward by the front pivotable lever 66, thereby causing the middle and rear pivotable levers 70, 74 to rotate into a near vertical position as shown in FIG. 3. Note that it is important that the pivotable lever 66, 60, 74 do not over rotate to or beyond the vertical.

Figure 5:
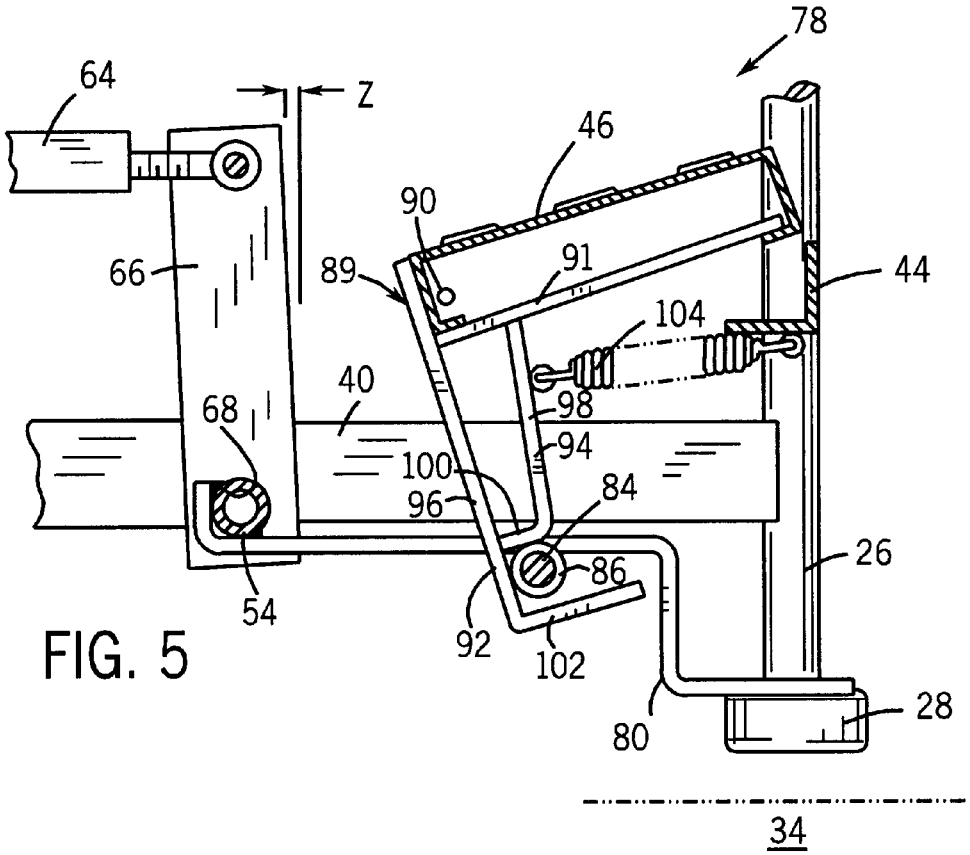
FIG. 5 is a detailed view taken along line 5—5 in FIG. 9 of a proportion of the actuation mechanism for the wheels showing the position of the actuation mechanism when the wheels are extended and the ladder stand is in a mobile position.
Figure 6:
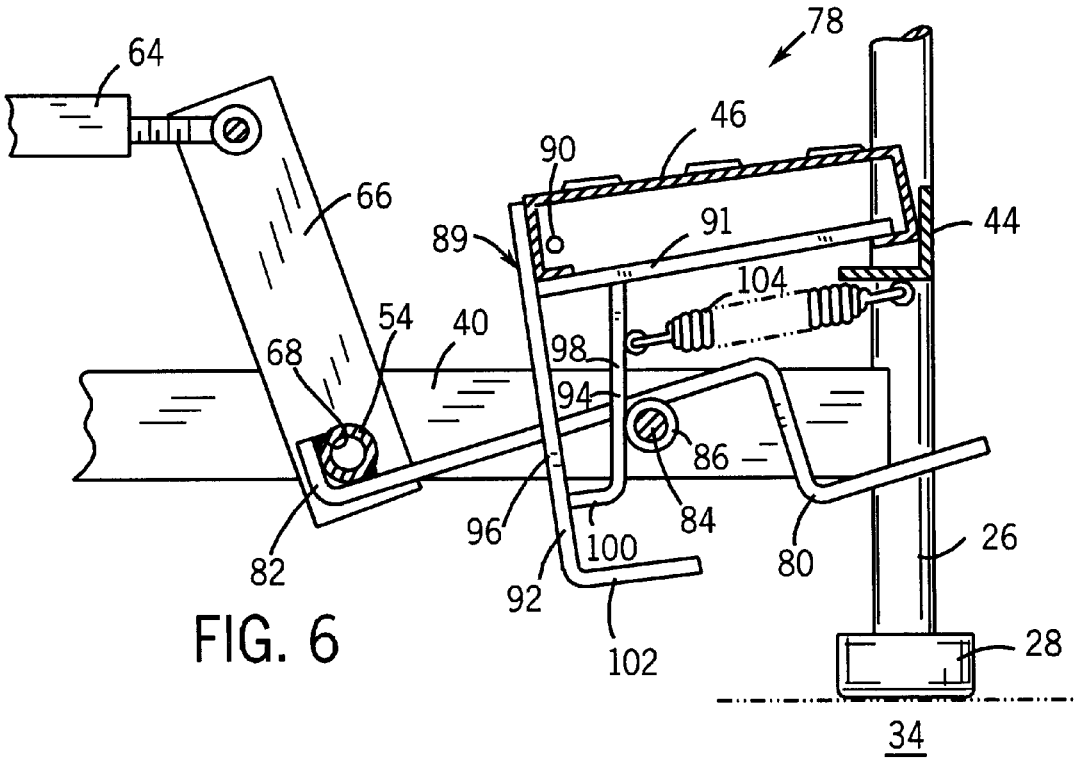
FIG. 6 is a detailed view of a portion of the actuation mechanism for the wheels showing the position of the actuation mechanism when the wheels are retracted and the ladder stand is in a non-mobile position.

The prepared actuation mechanism 78 is now described in connection with FIGS. 5, 6 and 9. Note that FIGS. 5 and 9 are views showing the ladder stand in the mobile position with the foot pads 28 lifted off of the ground surface 34. FIG. 6 shows the ladder stand in the nonmobile position in which the ladder stand is supported on the ground surface 34 by foot pads 28. The actuation mechanism 78 includes a pair of foot pedals 80 which when stepped on by the user extend the wheels 60, 62 and raise the foot pads 28, 32 off of the ground surface 34. The far end of the foot pedals 80 is welded to the bottom portion of the front pivotable levers 66. A release rod 84 passes through a central collar. Ends of the release bar 88 are attached to the bottom surface of each of the pedals 80.

The lower most stair tread 46 is mounted on a pivotable release lever structure 89. The pivotable release structure 89 pivots above pivot point 90, which constitutes a pivotable attachment of the structure 89 to the stair rails 24. Besides the stair tread 46, the pivotable release structure 89 includes a stair platform 91, as well as an L-shaped member 92 that extends from the rear central portion of the lower most stair tread 46, and a shorter reverse L-shaped section 94 which extends downward from the platform 91 and connects to the downward extending leg 96 of the L-shaped section 92. The leg 98 of the shorter reverse L-shaped member 94 slants towards the downward extending leg 96 of the larger L-shaped member 92. A catch for collar 86 is provided between the foot 100 of the smaller reverse L-shaped member 94 and the foot 102 of the larger L-shaped member 92. A spring 104 connects the reverse L member 98 to the front cross bar 44. The purpose of the spring is to bias the rotation of the pivotable release member 89 towards the front leg 26 when the collar 86 is located within the catch between foot portions 100 and 102 on the release structure 89. In this manner, the wheels 60, 62 are reliably locked in the extended position in order to allow convenient rolling of the ladder stand 10 over the ground surface 34. Arrows labeled by the letter Z in FIG. 5 illustrate that the location of the front pivotable lever 66, when the pedals 80 are pressed to the fully down position, is shy of a complete vertical rotation. It should therefore be appreciated that the spring 104 should be sufficiently strong to lock the wheels 60, 62 in the extended position when transporting the ladder stand 10. In order to release the actuation mechanism 78, a user steps on the lower most stair tread 46 thereby rotating the pivotable release structure 89 against the bias of the spring 104 as shown in FIG. 6. The front cross bar 44 is preferably made of angle iron, and acts as a seat of the front portion of the step platform 91 and the lower most stair tread 46. As the pivotable release structure 89 pivots away from the front legs 26, the central collar 86 is released from the catch between foot portions 100 and 102 on the pivotable release structure 89. As the collar 86 is release from the catch from the foot portions 100 and 102, the weight of the ladder stand 10 and the user causes the wheels 60, 62 to retract as illustrated in FIG. 4. As the wheels 60, 62 retract, the pivotable levers 70, 74 rotate rearward and pulls connection rod 64, which in turn causes pivotable lever 66 to rotate rearward. In turn, foot pedals 80 rotate upward as shown in FIG. 6. Note that weight on the lower most stair tread 46 causes spring 104 to expand. It should be appreciated to those skilled in the art that immediately upon placing weight 46, the collar 86 is released in the ladder stand 10 is immediately lowered onto foot pads 28 and 32.

Referring to FIG. 7, the rear wheel 62 are connected to mounting platforms 106 that are welded to the bottom portion of the rear pivotable lever 74. The mounting plat forms 106 are located below the pivot rod 58. The rear wheels 62 are mounted to swivel casters 108, which are mounted to the bottom surface of the respective mounting platform 106. The swivel casters 108 allow the rear wheels 62 to rotate 360°. Preferably, the diameter of the rear wheels is approximately 4 inches. Note also in FIG. 7 that the connecting rod 64 is pivotably mounted to the top portions of the pivotable lever 74 by connecting 110.

Referring to FIG. 8, wheel mounting platforms 112 are mounted to the metal pivotal levers 70. Note that the mounting platforms 112 span above the pivot rod 56. The wheels 60 have a bracket connected to the bottom surface of the respective mounting platform 112. The orientation of the wheel 60 is fixed in the longitudinal direction between the front and the rear of the ladder stand 10. Preferably, the diameter of the middle wheels 60 is greater than the diameter of the rear wheels 62. The preferred diameter of the middle wheel 60 is approximately 5 inches.

Referring briefly to FIG. 2, when the ladder stand 10 is in the mobile position (i.e. the wheels 60, 62 are extended), the foot pads 28 and 32 are listed above the ground surface 34 and the ladder stand 10 tilts slightly rearward as it is supported for rolling over the ground surface 34 by the larger middle wheels and the smaller rear wheels 62. The smaller rear wheels 62 are mounted on swivel casters and therefore the ladder stand 10 is easy to maneuver. In use, the user of a ladder 10 will lift slightly up on the form legs 26 and will push the ladder 10 forward. If the user desires to turn the ladder stand 10 sharply, the user can stop the ladder and rotate the ladder 10 about the pair of middle wheels 60. The rear wheels 62 on casters follow as the ladder 10 is rotated by the user.

Various alternatives and other embodiments are contemplated as being within the scope of the following claims which particularly point out and distinctly claim the subject matter regarded as the invention.

We claim:

1. A mobile ladder stand comprising:

a frame having at least two side beams and a front portion, a rear portion and a middle portion, wherein the front portion, the rear portion, and the middle portion are located along a longitudinal axis, and the middle portion is generally equidistant from the front portion and the rear portion, respectively;

a plurality of stair treads extending upward from the front portion of the frame;

a front pair of footpads mounted to the front portion of the frame;

a rear pair of footpads mounted to the rear portion of the frame;

a middle retractable wheel set mounted at the middle portion of the frame, the middle retractable wheel set comprising a pair of wheels fixed to roll in the longitudinal direction of the frame; and a rear retractable wheel set mounted at the rear portion of the frame, the rear retractable wheel set comprising a pair of swivel casters; and wherein the ladder stand has a mobile position in which the middle and rear wheel sets are extended and the ladder stand is supported on a ground surface entirely by the middle and rear wheel sets thereby enabling the frame to be moved on the ground surface; and the ladder stand also has a non-mobile position in which the middle and rear wheel sets are retracted and the ladder stand is supported on the ground surface by the front and rear foot pads, thereby preventing the ladder stand from rolling; and the mobile ladder stand further comprises:

an actuation mechanism that extends and retracts the middle and rear wheel sets.

2. A mobile ladder stand as recited in claim 1 wherein the actuation mechanism extends and retracts the middle and rear wheel sets in unison.

3. A mobile ladder stand as recited in claim 1 wherein the actuation mechanism comprises:

a foot pedal located near the front portion of the frame connected to a front pivotable lever;

a middle pivotable lever connected to the middle retractable wheel set;

a rear pivotable lever connected to the rear retractable wheel set;

and a mechanical linkage connecting the front pivotable lever to the middle pivotable lever and the rear pivotable lever.

4. A mobile ladder stand as recited in claim 3 wherein the mechanical linkage comprises a connecting rod that connects directly to the front pivotable lever, the middle pivotable lever and the rear pivotable lever.

5. A mobile ladder stand as recited in claim 3 wherein the actuation mechanism further comprises:

a locking mechanism that locks the middle and retractable wheel sets in the extended position; and a release lever that releases the locking mechanism to allow the middle and rear wheel sets to retract in response to weight on the release lever.

6. A mobile ladder stand as recited in claim 1 wherein the diameter of the pair of wheels for the middle retractable wheel set is larger than the first diameter of the pair of wheels for the rear retractable wheel set.

7. A mobile ladder stand as recited in claim 6 wherein the diameter of the pair of wheels for.the rear retractable wheel set is approximately four inches and the diameter of the pair of wheels for the middle retractable wheel set is approximately five inches.

8. A mobile ladder stand as recited in claim 1 wherein the middle and rear retractable wheel sets are located on the frame between the front and rear pair of footpads.

9. A mobile ladder stand is recited in claim 1 wherein the middle wheel set is located along the frame approximately midway between the front pair and the rear pair of foot pads.

10. A mobile ladder stand as recited in claim 1 further comprising a platform that is located higher than the uppermost stair tread.

11. A mobile ladder stand comprising:

a frame having at least two side beams and a front portion, a rear portion and a middle portion;

a plurality of stair treads extending upward from the front portion of the frame;

a front pair of footpads mounted to the front portion of the frame;

a rear pair of footpads mounted to the rear portion of the frame;

a middle retractable wheel set mounted near the middle portion of the frame, the middle retractable wheel set comprising a pair of wheels fixed to roll in the longitudinal direction of the frame; and a rear retractable wheel set mounted at the rear portion of the frame, the rear retractable wheel set comprising a pair of swivel casters;

an actuation mechanism that extends and retracts the middle and rear wheel sets, comprising:

a foot pedal located near the front portion of the frame connected to a front pivotable lever;

a middle pivotable lever connected to the middle retractable wheel set;

a rear pivotable lever connected to the rear retractable wheel set;

and a mechanical linkage connecting the front pivotable lever to the middle pivotable lever and the rear pivotable lever; and wherein the middle pivotable lever includes a pivotable collar telescoping a middle pivot bar connected to the frame;

the front pivotable lever includes a pivotable collar telescoping a front pivot bar connected to the frame; and the rear pivotable lever includes a pivotable collar telescoping a rear pivot bar connected to the frame;

and wherein the ladder stand has a mobile position in which the middle and rear wheel sets are extended and the ladder stand is supported on a ground surface entirely by the middle and rear wheel sets thereby enabling the frame to be moved on a ground surface; and the ladder stand also has a non-mobile position in which the middle and rear wheel sets are retracted and the ladder stand is supported on the ground surface by the front and rear foot pads, thereby preventing the ladder stand from rolling.

12. A mobile ladder stand comprising:

a frame having at least two side beams and a front portion, a rear portion and a middle portion;

a plurality of stair treads extending upward from the front portion of the frame;

a front pair of footpads mounted to the front portion of the frame;

a rear pair of footpads mounted to the rear portion of the frame;

a middle retractable wheel set mounted near the middle portion of the frame, the middle retractable wheel set comprising a pair of wheels fixed to roll in the longitudinal direction of the frame;

a rear retractable wheel set mounted at the rear portion of the frame, the rear retractable wheel set comprising a pair of swivel casters;

an actuation mechanism that extends and retracts the middle and rear wheel sets, comprising:

a foot pedal located near the front portion of the frame connected to a front pivotable lever;

a middle pivotable lever connected to the middle retractable wheel set;

a rear pivotable lever connected to the rear retractable wheel set;

a mechanical linkage connecting the front pivotable lever to the middle pivotable lever and the rear pivotable lever;

a locking mechanism that locks the middle and rear wheel sets in the extended position;

a release lever comprising a first of the plurality of stair treads which is pivotally mounted to the frame wherein the release lever releases the locking mechanism to allow the middle and rear wheel sets to retract in response to weight on the release lever, and wherein the ladder stand has a mobile position in which the middle and rear wheel sets are extended and the ladder stand is supported on a ground surface entirely by the middle and rear wheel sets thereby enabling the frame to be moved on the ground surface; and the ladder stand also has a non-mobile position in which the middle and rear wheel sets are retracted and the ladder stand is supported on the ground surface by the front and rear foot pads, thereby preventing the ladder stand from rolling.

13. An undercarriage for a mobile apparatus, the undercarriage comprising:

a frame having at least two side beams, a front portion, a rear portion and a middle portion, wherein the front portion, the rear portion, and the middle portion are located along a longitude axis, and the middle portion is generally equidistant from the front portion and the rear portion, respectively;

means for manually pushing the mobile apparatus, said manual pushing means being accessible from a side of the mobile apparatus at which the front of the frame is located;

a front pair of footpads mounted to the front portion of the frame;

a rear pair of footpads mounted to the rear portion of the frame;

a middle retractable wheel set mounted at the middle portion of the frame, the middle retractable wheel set comprising a pair of wheels fixed to roll in the longitudinal direction of the frame; and a rear retractable wheel set mounted at the rear portion of the frame, the rear retractable wheel set comprising a pair of swivel casters; and wherein:

the undercarriage has a mobile position in which the middle and rear wheel sets are extended and the apparatus is supported on a ground surface entirely by the middle and rear wheel sets thereby enabling the frame to be rolled on the ground surface; and the undercarriage has a non-mobile position in which the middle and rear wheel sets are retracted and the apparatus is supported on the ground surface by the front and rear foot pads, thereby preventing the mobile apparatus from rolling; and the undercarriage further comprises:

an actuation mechanism that extends and retracts the middle and rear wheel sets.

14. An undercarriage for a mobile apparatus as recited in claim 13 wherein the actuation mechanism extends and retracts the middle and rear wheel sets in unison.

15. An undercarriage for a mobile apparatus as recited in claim 13 wherein the actuation mechanism comprises:

a foot pedal located near the front portion of the frame connected to a front pivotable lever;

a middle pivotable lever connected to the middle retractable wheel sets;

a rear pivotable lever connected to the rear retractable wheel set; and a mechanical linkage connecting the front pivotable lever to the middle pivotable lever and the rear pivotable lever.

16. An undercarriage for a mobile apparatus as recited in claim 15 wherein the mechanical linkage comprises a connecting rod that is connected directly to the front pivotable lever, the middle pivotable lever and the rear pivotable lever.

17. An undercarriage for a mobile apparatus as recited in claim 15 wherein:

the actuation mechanism further comprises:

a locking mechanism that locks the middle and rear wheel sets in the extended position; and a release lever that releases the locking mechanism to allow the middle and rear wheel sets to retract in response to weight on the release lever.

18. An undercarriage for a mobile apparatus as recited in claim 15 wherein the diameter for the pair of wheels of the rear wheel set is approximately four inches, and the diameter for the pair of wheels of the middle wheel set is approximately five inches.

19. An undercarriage for a mobile apparatus as recited in claim 13 wherein the middle wheel set comprises a pair of wheels having a diameter that is larger than the diameter of the wheels of the rear wheel set.

20. An undercarriage for a mobile apparatus as recited in claim 13 wherein the middle and rear wheel sets are located along the frame between the front pair and the rear pair of foot pads.

21. An undercarriage for a mobile apparatus as recited in claim 13 wherein the middle wheel set is located along the frame approximately midway between the front pair and the rear pair of footpads.

22. An undercarriage for a mobile apparatus, the undercarriage comprising:

a frame having at least two side beams, a front portion, a rear portion and a middle portion;

means for manually pushing the mobile apparatus, said manual pushing means being accessible from a side of the mobile apparatus at which the front of the frame is located;

a front pair of footpads mounted to the front portion of the frame;

a rear pair of footpads mounted to the rear portion of the frame;

a middle retractable wheel set mounted in the middle portion of the frame, the middle retractable wheel set comprising a pair of wheels fixed to roll in the longitudinal direction of the frame; and a rear retractable wheel set mounted near the rear portion of the frame, the rear retractable wheel set comprising a pair of swivel casters;

an actuation mechanism that extends and retracts the middle and rear wheel sets, comprising:

a foot pedal located near the front portion of the frame connected to a front pivotable lever;

a middle pivotable lever connected to the middle retractable wheel sets;

a rear pivotable lever connected to the rear retractable wheel set; and a mechanical linkage connecting the front pivotable lever to the middle pivotable lever and the rear pivotable lever; and wherein the middle pivotable lever includes a pivotable collar telescoping a middle pivot bar connected to the frame;

the front pivotable lever includes a pivotable collar telescoping a front pivot bar connected to the frame; and the rear pivotable lever includes a pivotable collar telescoping a rear pivot bar connected to the frame;

and wherein the undercarriage has a mobile position in which the middle and rear wheel sets are extended and the apparatus is supported on a ground surface entirely by the middle and rear wheel sets thereby enabling the frame to be rolled on the ground surface; and the undercarriage has a non-mobile position in which the middle and rear wheel sets are retracted and the apparatus is supported on the ground surface by the front and rear foot pads, thereby preventing the mobile apparatus from rolling.

* * * * *